United States Patent [19]

Mathis

[11] Patent Number: 4,928,588

[45] Date of Patent: May 29, 1990

[54] APPARATUS FOR DRY PRINTING ONTO A WORKPIECE USING A HOT EMBOSSING FILM AND AN EMBOSSING DIE

[76] Inventor: Walter Mathis, Feldheim 1, CH - 6312 Steinhausen, Fed. Rep. of Germany

[21] Appl. No.: 303,753

[22] Filed: Jan. 30, 1989

[30] Foreign Application Priority Data

Feb. 1, 1988 [DE] Fed. Rep. of Germany ..... 3802885
Aug. 30, 1988 [DE] Fed. Rep. of Germany ..... 3829297

[51] Int. Cl.[5] ..... B41F 17/00

[52] U.S. Cl. ..... 101/9; 101/7; 101/25; 101/379

[58] Field of Search ..... 101/8, 9, 5–7, 101/25, 27, 31, 379

[56] References Cited

U.S. PATENT DOCUMENTS 3,613,570 10/1971 Gladen ..... 101/9
3,726,212 4/1973 Combs ..... 101/27 X
3,946,195 3/1976 Lyons et al. ..... 101/31 X
3,961,575 6/1976 Rodabaugh ..... 101/31 X
4,658,721 4/1987 Mathis ..... 101/9

*Primary Examiner*—Clifford D. Crowder
*Attorney, Agent, or Firm*—Max Fogiel

[57] ABSTRACT

An apparatus for dry printing onto a workpiece (12) using a hot embossing film (10) and an emobssing die (1) is shown, whereby the hot embossing film (10) adheres onto the workpiece (12) corresponding to the embossing die (1) and after a cooling period the film, except for the impression itself, is released from the workpiece. The walls of the die body (2) are so thin that, as it is placed onto the workpiece (12) to be printed onto, it forms locally and elastically onto the workpiece surface (11). The side of the die body (2) facing away from the die face (3) displays a positive force transfer relief (7), which corresponds to or which is similar to the die face (3). On the side of the die body (2) facing away from the die face (3) there is an elastic pressure pad (8) for the die body (2) to form locally and elastically.

19 Claims, 8 Drawing Sheets

Figure 1:
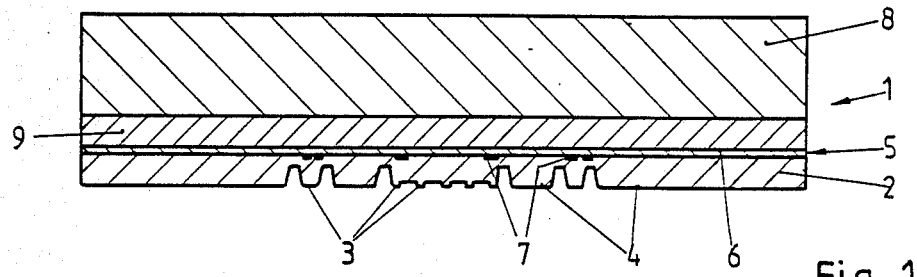

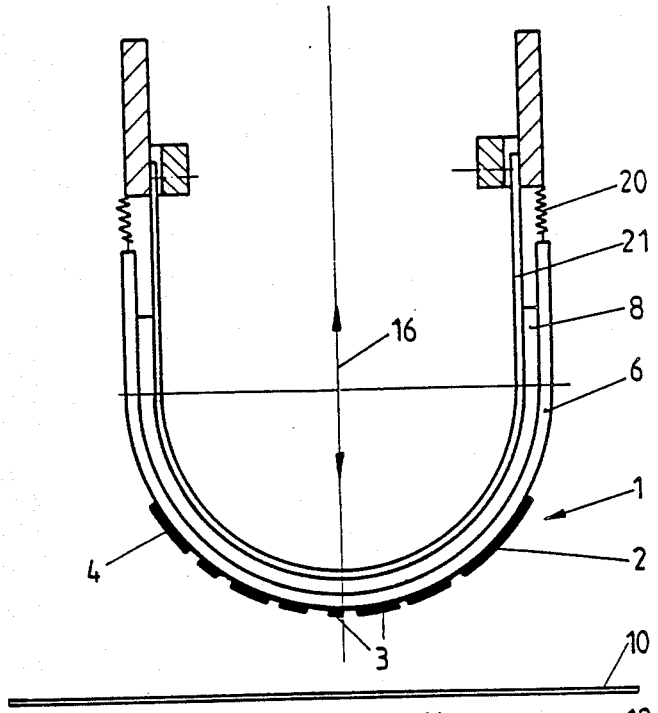
Fig. 8
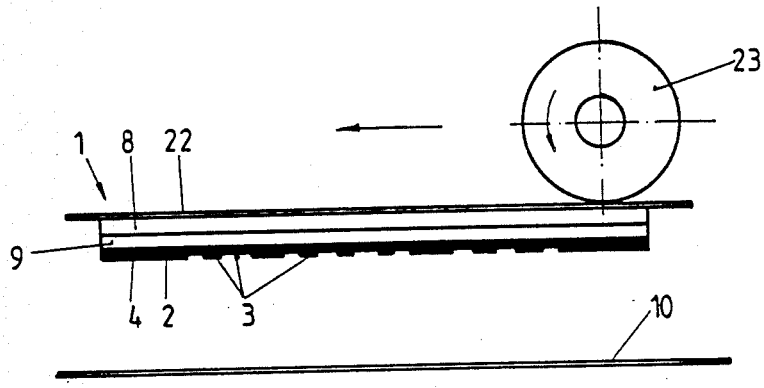
Fig. 9
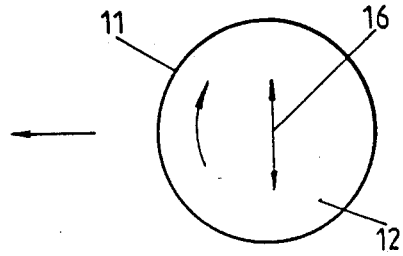

APPARATUS FOR DRY PRINTING ONTO A WORKPIECE USING A HOT EMBOSSING FILM AND AN EMBOSSING DIE

The invention relates to an apparatus for dry printing onto a workpiece using a hot embossing film and an embossing die, and applying heat, pressure and time, whereby the workpiece and the embossing die come together relative to each other, are held in contact by intermediate clamping of the hot embossing film, so that heat is transferred and then removed, whereby the hot embossing film adheres onto the workpiece corresponding to the embossing die and after a cooling period the film, except for the impression itself, is released from the workpiece, with a receiving station for the workpiece, a feeding device working in synchronisation for the hot embossing film and a heating device for the embossing die which is in elastically formable material and representing a die body. The invention has particular use in printing onto flexible hollow bodies in plastic or having a plastic layer on their surface using the hot embossing film printing method. Thus it is possible to print onto, for example, blown plastic bottles of whatever section, especially for the cosmetics industry. Therefore, it does not matter how the workpiece surface to be printed is shaped in detail; this surface may have in particular a flat, convex/round, convex/oval or even a concave shape.

The hot embossing film printing described here is a dry printing method, whereby the hot embossing film is adhered or melted onto the workpiece surface to be printed. The hot embossing film itself consists of a carrier strip, a separating layer, preferably a protective lacquer, its own layer of paint often including an additional metal layr, and the layer for adhering or uniting with the plastic surface to be printed onto.

In the printing process all the other layers, except for the carrier strip are applied onto the surface to be printed and after suitable cooling down of the hot embossing film and the carrier strip, are then separated away at the point where they adhered to or united with the surface to be printed onto. An apparatus of the kind described in the preamble is known from DE-PS 34 21 029, in which both the basic printing methods used up to now are described, namely on the one hand the lift-off method and on the other the roll-off method. For its part DE-PS 34 21 029 shows a method for dry printng, whereby the embossing die is brought into contact with the workpiece across the entire die face by successive application, and whereby in at least the area of the die face the embossing die is formed into the shape corresponding to the workpiece. The embossing die consists of a backing piece, e.g. a thin metal strip, and a die body e.g. of a rubber mixture displaying a die face corresponding to the desired impression. The heat is produced in the backing piece and is transferred by heat conduction through the die body into the die face, where it is transferred onto the hot embossing film and the surface of the workpiece to be printed onto.

Aside from rigid embossing dies, more or less elastic embossing dies are used in the hot embossing printing mehtod, so that the raised parts of the embossing die may as far as possible match all the unevennesses on the surface of the workpiece to be printed onto. The shaping of the elastic embossing die on the raised parts is done under force. Through exercising this force the die face of the die body matches the unevennesses on the surface of the workpiece to be printed onto; however, in doing so clearly detectable distortions occur in the print.

This is particularly the case where comparatively large forces are being used. In particular this has the effect of squashing fine lines or thin characters and the impression becomes distorted and may even be illegible. As soon as any specific quality demands are made on the impression, these disadvantages severely limit the applications for hot embossing film printing.

It is known that, with respect to fashioning those of their surfaces which are to be printed onto, workpieces to be printed can only be manufactured within tolerances, so within specific tolerance ranges. Therefore, it is not possible to avoid the occurrence of unevennesses, two-dimensional sunk spots, etc. An example of this is that with a flat impression extending across such sunk spots, spots occur on which the hot embossing film does not obtain the necessary contact with the surface to be printed onto. It is possible to counteract this by pressing harder from the reverse side of the workpiece, for example by inflating a bottle to be printed onto. Another possiblilty lies in shaping the embossing die thicker. The two measures may be used in combination; however, they do prove disadvantageous whether singly or in combination. Through a greater pressure from behind the delicate rubber of from which the die body is made, is stressed excessively, so that embrittlement occurs and squeezing out causes damaging. Also the characters are easily squashed in the same kind of way. On the other hand if the rubber layer of the die body of the embossing die is then made thicker, the heat conduction distances then become longer and bigger. Therefore, for the transfer of the heat required, a greater temperature difference must be made available, i.e. the backing piece in which the heat is produced must be heated up more. Then again the material of the die body is more greatly affected by the temperature and additional damaging occurs. Eventually, this also results in a reduction in the service life of the embossing die.

It is possible to achieve certain improvements if postion deviations of the embossing die onto the surface of the workpiece to be printed onto are corrected automatically in the printing process, as is described in international application WO 81/01536. The position deviation of the embossing die may be further subdivided if the embossing die is subdivided into individual segments which are supported separately and elastically, as is shown in U.S. Pat. No. 3 961 575. However, in many cases such a subdividing is not possible, for example where continuous fine lines have to be printed across the entire impression. With the measures described it is possible to reduce the defects and deviatons, but the unevennesses, e.g. in the wall thickness variations of a hollow body do still need to be corrected in the subzones involved. So the negative effects on the quality of the impression remain basically unchanged with such measures.

The object of the invention is to create an apparatus of the kind described in the preamble, which has a good service life and with which workpiece with geometric deviations in the surface, so for example with sunk spots, unevennesses and/or wall thickness variations, especially with flexible hollow bodies, may be printed onto neatly and with great efficiency with the hot embossing printing method, whereby the delicate embossing die experiences the least possible thermal and mechanical loadings.

This is achieved in accordance with the invention in that the walls of the die body are so thin that, as it is placed onto the workpiece to be printed it forms locally and elastically onto the workpiece surface, that the side of the die body facing away from the die face displays a positive force transfer relief, which corresponds to or which is similar to the die face, and that on the side of the die body facing away from the die face there is an elastic pressure pad for the die body to form locally and elastically.

The die body is made with particularly thin walls and in fact in such a way that it may form locally and elastically within its face, so that the possibility then exists to follow the unevennesses and sunk spots on the workpiece to be printed onto within, for example, a flat plane. On the reverse side of the die body there is a positive force transfer relief, in other words parts which are intended to serve for transferring forces onto the die body and the die face. These forces are not particularly great but are primarily quite specifically directed at imposing the smallest possible localized forces, which, however, are sufficient to produce a neat impression. The relatively small forces also act to advantage with respect to the service life of the embossing die and consequently of the die body too, because in this respect mechanical demands on the elastic material are slight. The recovery behaviour of the elastic material of the die body, as other components of the embossing die too, is not affected. This force transfer relief is positive, i.e. represents a positive. It possesses true to side the same or a similar presentation as the impression to be produced on the workplace. The contact face of the force transfer relief may project out of the back surface of the die body or even be enclosed flush in this surface. It is also possible to select individually the width dimensions of the contact face to be different from the shape fo the die face on the die body. However, the two must always correspond to one another, i.e. a transfer of force must be possible from back to front, in other words from the force transfer relief to the die face. On the die body there is on the side facing away from the die side an elastic pressure pad for elastic forming of the die body or in any event for pressing, so that with the aid of this pressure pad of the thin die body it is possible to form elastically and locally, so that sunk spots and unevennesses are bridged, and indeed without the die body being loaded mechanically and thermally more than necessary.

The distances over which the forces are sent, ultimately the pressure admission of the elastic material of the die body, are very short. The same applies to the thermal loading. Through the localized heating of parts of the die body, in a case where the heating device is provided for example in the die body, short distances are created for heat conduction and the material of the die body is not thermally overloaded. If for example a temperature of 250° to 270° C. has to be supplied in the die face, then the heating device is operated at approximately 260° to 280° C. at the source location of the heat. The fact that the walls of the die body are so thin proves advantageous for high flexibility and consequently for compensating defective spots, sunk spots and wall thickness variations, and indeed if the smallest forces are being used in the pressure pad. This means that mechanical demands on the die body and the die face are slight and a good service life of the embossing die results. Furthermore, by using the apparatus built in accordance with the invention, rejects are substantially reduced, or if not, practically completely prevented, because even workpieces with tolerances lying at the limit of the tolerance range may still be printed onto reliably. Also, by individual localized shaping of the heating device, it is possible to produce differing localized temperatures at the different parts of the die face and so at the impression. In this manner flat shaped batches may be handled individually against fine lines. Because of the low wall thickness of the die body of the embossing die, to a limited extent it is also possible to print onto spherical workpieces. Furthermore, it is an advantage that the setting-up time of a printing machine which is equipped with the new apparatus is substantially shortened, because the embossing die matches tolerances better and to a greater extent.

Finally, energy consumption is substantially reduced. The heat energy consumed in the hot embossing film printing is approximately 1/20 to 1/30 of the heat energy needed up to now. The raised parts of the die face of the embossing die are pressed onto the workpiece to be printed onto with less force than previously even in the area of the unevennesses of the surface of that workpiece, whereby this pressing takes place by the pressure pad under very low pressure. Therefore, squeezing by material of the die body is prevented, so that no line intensity variations occur by squeezing. The pressure pad must finally only be pretensioned to the point that the force is produced which is necessary to bring the raised spots in the area of the die face into contact with the surface of the workpiece to be printed onto, in coordination with the elasticity of the embossing die.

The heating device may be provided on or in the die body and concentrated locally to correspond with the impression, so that the heating device also forms the shape of the force transfer relief. So the heating device is formed as conductor plate, whereby the individual conductors are led and laid out in such a way that they are at least similar to the impression. Since, because it consists of metal, in this respect the material of the heating device is inelastic, hard spots occur in the elastic material of the die body, these being the force transfer relief, which is available as effective, without there being any raised parts protruding towards the rear side. Since the heating device is no longer on the backing piece of the embossing die, but rather it is directly on or in the die body, and also because of the small wall thicknesses of the die body, extremely small distances arise over which the heat has to be transported by heat conduction.

In this way the heating device no longer extends flat across the base body of the embossing die, but rather it is concentrated locally to correspond with the impression, so that almost every raised part of the die face, together forming the impression, is heated individually.

In another embodiment of the invention both the die body on the one side of a carrier body and the force transfer relief on the other side of the carrier body are provided in elastically formable material. The carrier body itself may be a metal strip in particular aiding operation or also a rubber strip. In this embodiment the parts of the force transfer relief project backwards across the face on the rear side of the die body, so that in this way they enable the transfer of minimal, yet sufficiently large forces by contact with the pressure pad.

The force transfer relief, in particular on its contact surface with the pressure pad is shaped similarly, and in fact the same as, smaller or larger than the die face of the die body. If the force transfer relief consists of a conductor in metal, it is advisable for the conductor run to be made smaller than the periphery of the die face of the embossing die. On the other hand, if the force transfer relief consists of raised parts in elastically formable material, then it may be advisable to make it larger than the die face of the die body, that is to say the characters and lines positive on the reverse side are made greater in their width and height than those characters which form the impression in the die face. This helps to achieve a reduction in the contact pressure between the force transfer relief and the surface of the pressure pad and this also works positively in extending service life.

Exactly equal proportioning of the force transfer relief is possible if this relief may be taken without problem as positive from a negative. There are manufacturing advantages where proportions are the same.

The heating device may be provided in the die body between the relief representing the die face and the force transfer relief, and at the same time form the carrier body, so that with the aid of the carrier body or the heating device the die body may be handled simultaneously, i.e. held clamped in a machine and carried. In this way the carrier body has twin functions.

The die body with the force transfer relief is provided in the form of a plate which can move to and fro or a circulating driven belt. A drive moving a belt back and forth is also possible. The individual choice depends on desired service lives, the printing velocity required etc. The apparatus in accordance with the invention makes it possible to create hot embossing stations which may be deployed as work stations also in combination with screen printing stations, because with the apparatus in accordance with the invention the working rate in hot embossing may be increased so much that it attains the working rate of the screen printing stations, so that the two differing types of printing stations may be operated without trouble in one working line next to or behind each other.

However, it is also possible to provide the heating device outside the die body and the heat transfer takes place directly onto the die face. For this heat transfer may be produced from, for example an infra red source.

The heat may be put onto the die face with or without contact from an intermediate roller or similar, so that upon the next contact during hot embossing film printing it does not have to cover any more distances in the die body, but rather is is available directly at the print position.

Between the heating device and the die face of the die body an aperture may be provided, whereby the heating devide and/or the aperture are positioned at a fixed point or are movable. Such an aperture makes it possible, for example in conjunction with an infra red heat source, specifically to transfer heat only onto the die face and to leave the neighbouring faces of the die body, which may act as bearing faces, comparatively colder, so that printing defects are already impossible in this way. Especially if it has a fixed position the aperture may also be cooled so that it does not itself become a heat source through the infra-red irradiation. It is also possible to place the aperture or several apertures on a continuous belt, whereby the back side of this belt may be taken through a cooling chamber or similar in order to eliminate excess heat.

The hardness of the pressure pad should be matched to the hardness of the material of the die body, and in such a way that the die body is able to form elastically. If the die body is particularly soft, then the pressure pad should be equally soft. If the die body exhibits greater hardness, then the pressure pad must also be in the position to overcome this greater hardness. Of course, it is advisable to select the softness possible type because it is not a question of producing a high contact force of the die face onto the hot embossing film and so onto the surface of the workpiece to be printed onto, but rather it is simply a question of elastic localized forming of the die body.

This forming should be just right so that, despite this forming of the die body, all parts of the die face are pressed onto the hot embossing film with roughly the same contact force.

The force transfer relief may be shaped in its contact surface the same as the die of the die body, and there may be a rubber strip separator between the contact surface and the pressure pad. This rubber strip protects the pressure sensitive pressure pad from the force transfer relief pressing into the material of the pressure pad, so preventing any damage to the pressure pad. The rubber strip separator bears the forces carried past it on the pressure pad on a larger surface which serves to increase service life.

A hydraulic or pneumatic pad, a padding in foam or similar may be provided as pressure pad. Pneumatically inflated bellows also fulfil their function here. It is also possible to shape the pressure pad as a plug.

As heating device there may be a conductor plate with a carrier film and on that a metal resistance strip corresponding to the shape and disposition of the impression. Of course, it is also possible to fit several metal resistance strips. The carrier film only has the task of accepting and holding the metal resistance strip. Both the carrier film and the metal resistance strip are extremely thin and may be positioned immediately behind the die body in such a way that the metal resistance strip is turned towards the die body. Naturally, it is also possible to mould the conductor plate into the material of the die body. In this case particularly short heat conduction distances are obtained.

A heat insulation layer in elastic material may be provided between the carrier film of the conductor plate and the pressure pad. This layer may be an integral part of the pressure pad or there again an independent layer in a material that is different from that of the pressure pad.

The die body itself may be shaped in areas as bearing mask, while in other areas it represents the die face. These two areas may also, for example, be made in different materials. The die body representing the die face consists preferably of a material mixture which conducts heat well. In the area of the bearing mask, a material may be used which does not conduct heat well. In conjunction with the heating device acting locally, the achievement is that the required high temperature for embossing is only engaged where the die body represents the die face, while on the parts forming the bearing mask the temperature is lower, so that the paint coating is not released from the embossing film. However, it is also possible to form the areas forming the bearing mask in a material which conducts heat well, whereby these areas then have to be cooled.

The pressure pad may be permanently joined to the die body, so that the embossing die is formed almost in one piece. It is also possible to form it separately, although generally this is not to be recommended. Through the conjunction between pressure pad and die body, it is possible to harmonize exactly the springing characteristics of the pressure pad with the elasticity of the die body. The pressure pad may have in particular a larger wall thickness than the die body so that localized compressions of the pressure pad do not or only scarcely express themselves in a change in the contact force.

The pressure pad may also consist of heat-insulating material and so take over the function of heat-insulation layer. A separate heat-insulation layer is then unnecessary.

The pressure pad may be designed to produce a force of approximately 100 g/cm$^2$. This extremely low contact force shows clearly that it is not a question of using high contact forces in hot embossing film printing; it is simply necessary to achieve a good flat positioning of the die face on the unevennesses of the surface of the workpiece to be printed onto. In the first instance the pressure pad serves for the elastic forming of the die body and the force to be imposed by it is coordinated with that. In addition it also ensures the contact with the hot embossing film or the application of the hot embossing film on the workpiece surface.

Figure 2:
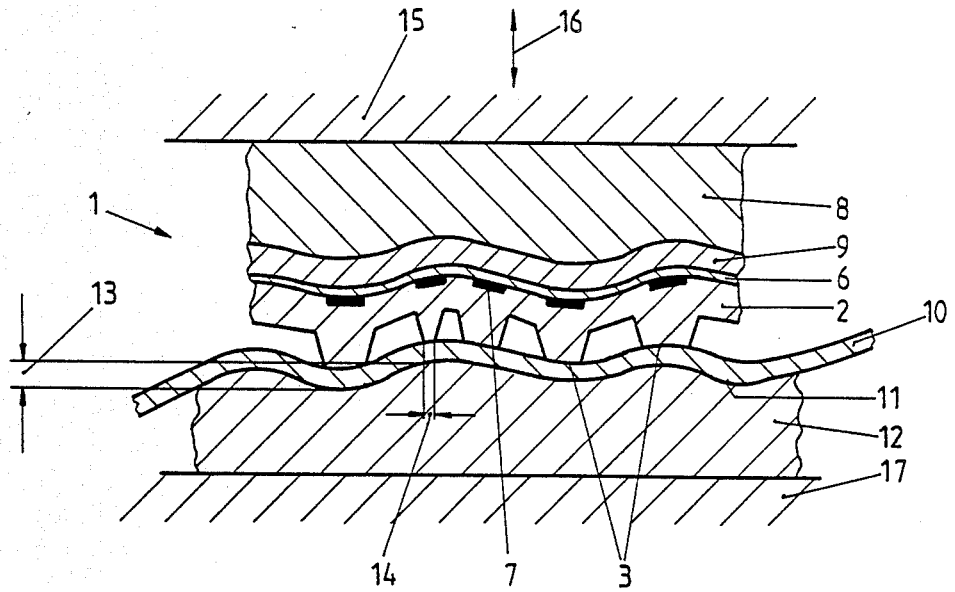
Figure 3:
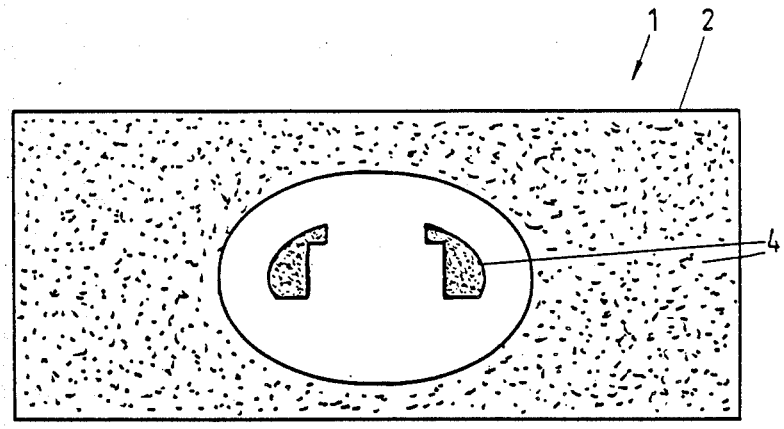
Figure 4:
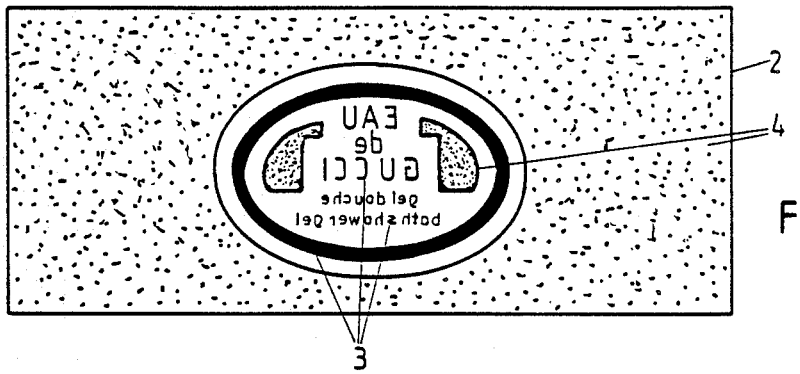
Figure 5:
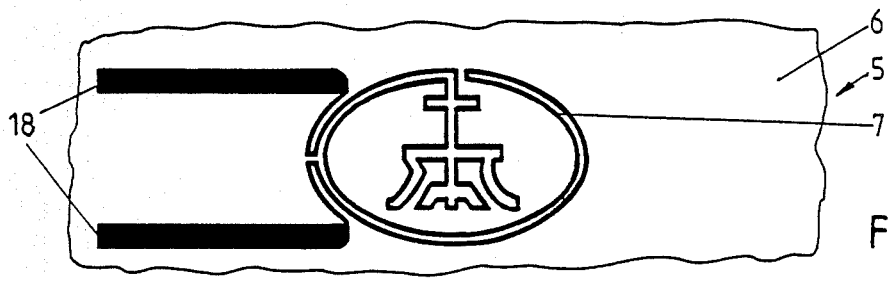
Figure 6:
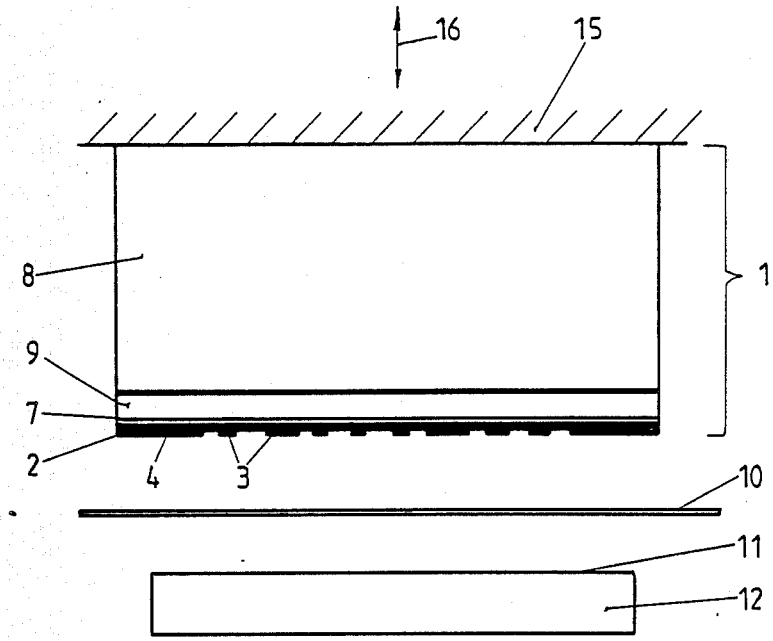
Figure 7:
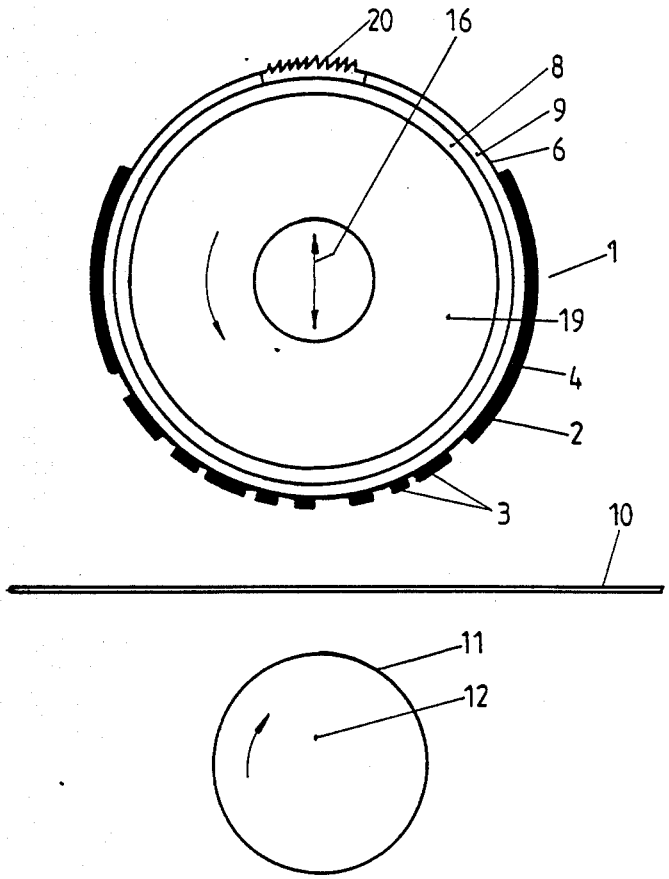
Figure 10:
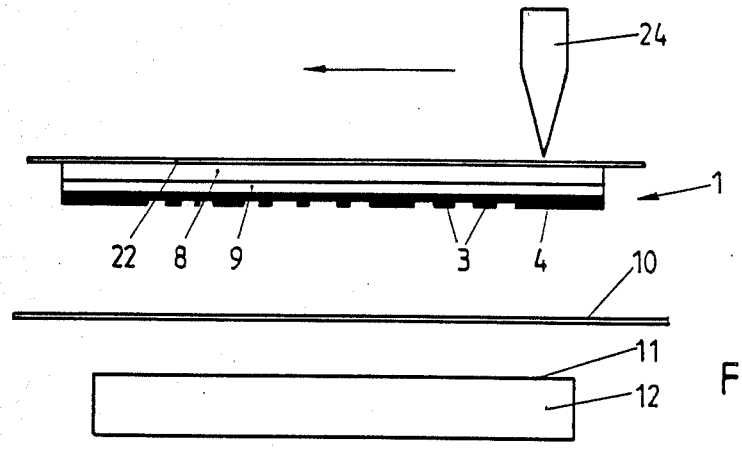
Figure 11:
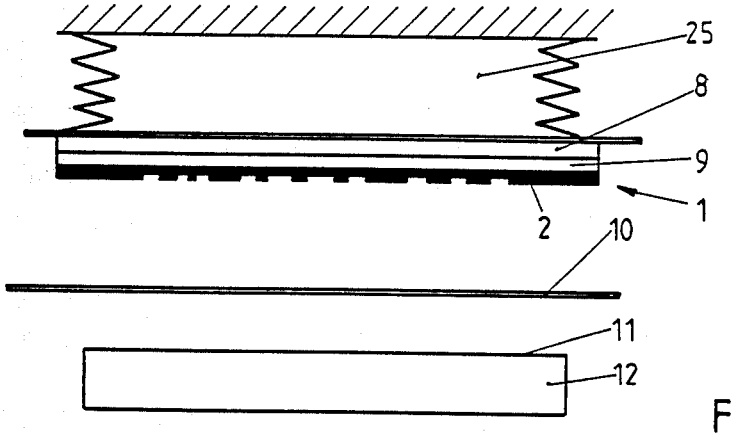
Figure 12:
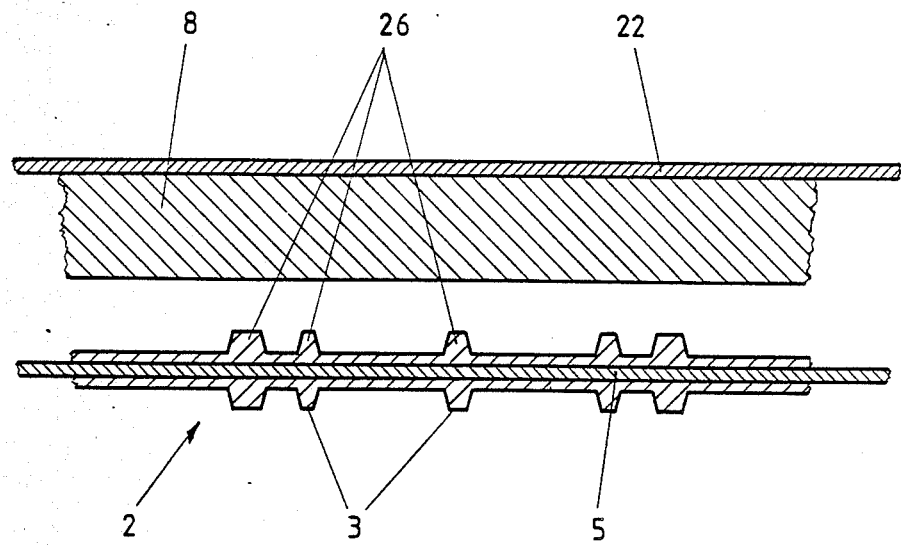
Figure 13:
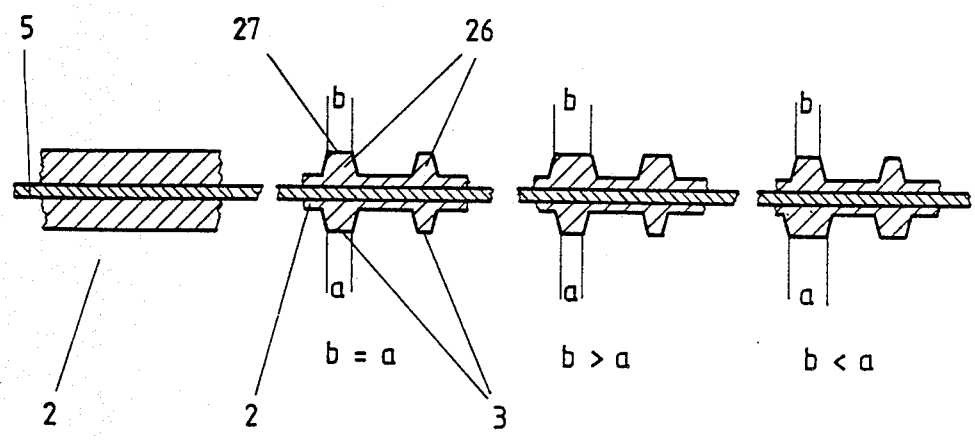
Figure 14:
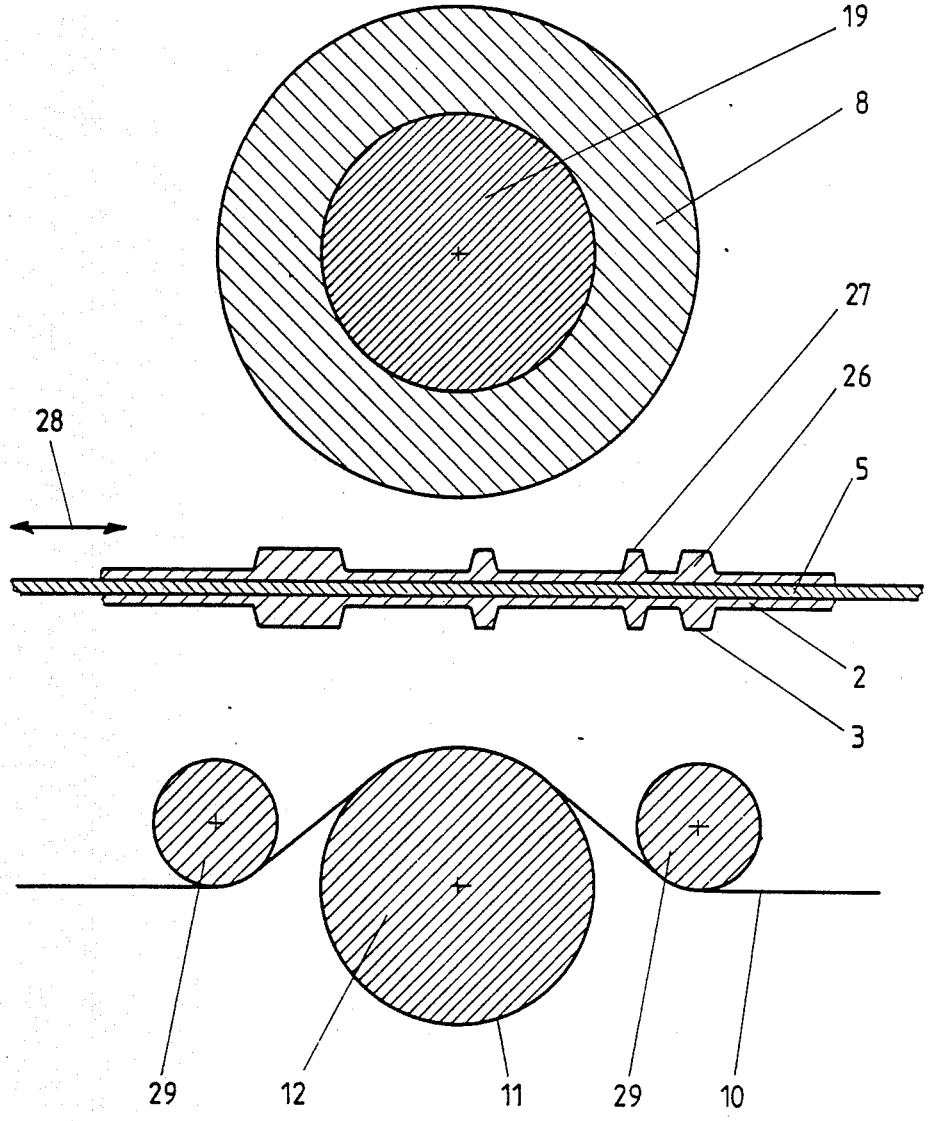
Figure 15:
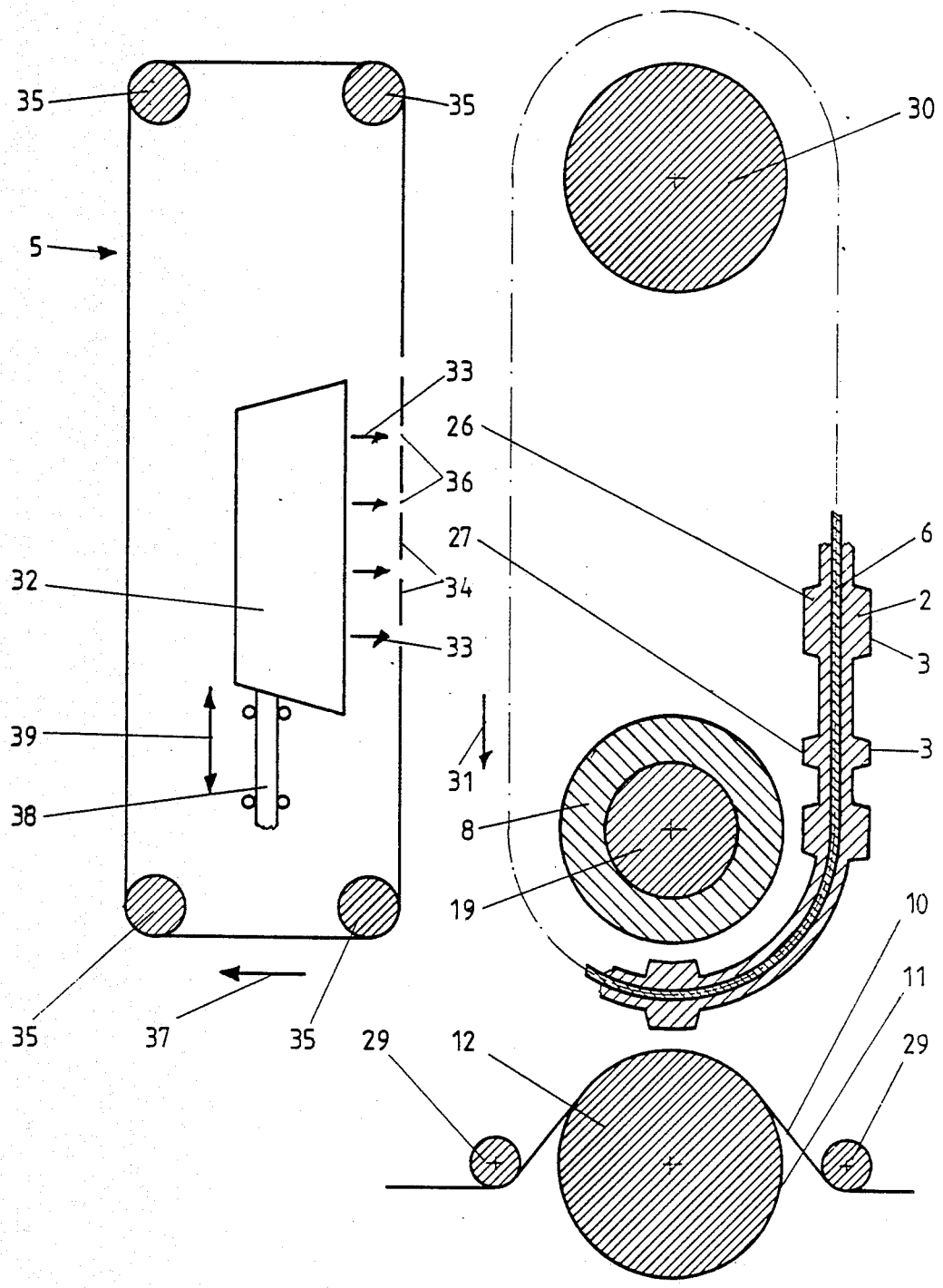

The invention will be further illustrated and described with reference to several example embodiments:

FIG. 1 shows a cross-section of the embossing die in a first embodiment,

FIG. 2 shows a cross-section through a part of an embossing die during hot embossing film printing, FIG. 3 shows an elevation of the parts of the die body of the embossing die which fulfil, in one example embodiment the function of bearing mask, FIG. 4 shows a representation similar to FIG. 3 with the complete die body, FIG. 5 shows an elevation of the conductor plate belonging to the example embodiment of FIGS. 3 and 4, FIG. 6 shows a diagrammatic representation of the apparatus parts essential to the invention in printing onto a flat workpiece, FIG. 7 shows a further manner of transfer in printing onto a cylindrical workpiece, FIG. 8 shows a further possibility in printing onto the concave surface of a workpiece, FIG. 9 shows a further, basic layout in printing onto a cylindrical workpiece, FIG. 10 shows a further possibility in printing onto a flat workpiece, FIG. 11 shows a further layout possibility in printing onto a flat workpiece, FIG. 12 shows a cross-section of a further embodiment of the embossing die, FIG. 13 shows detail representations of different embodiments in a die body, FIG. 14 shows a further possible embodiment for the construction of an embossing die at a printing station and FIG. 15 shows a further embodiment of a printing station.

FIG. 1 illustrates the bsic construction of an embossing die (1). The embossing die (1) represents a die body (2) which consists of a rubber mixture and which carries a die face (3) shaped with raised parts, which corresponds in negative form with the impression, or in other words the print to appear on the workpiece to be printed onto. Other areas of the die body (2) and the die face (3) may form a bearing mask (4).

In the material of the die body (2) or, as represented here, directly on the die body (2) on the side facing away fron the die face (3), a heating device (5) is arranged, which is essentially formed as conductor plate and so may represent a carrier film (6), on which one or more metal resistance strips (7) are arranged, and in a position relative to the raised parts of the die face (3), which must be heated correspondingly. The comparatively hard and consequently inelastic parts of the metal resistance strips (7) represent a positive, inset force transfer relief, which serves to transfer small yet necessary forces from the pressure pad into the die face and then onto the workpiece. On the reverse side of the die body (2) thus constructed, there is a pressure pad (8) in compensating, springing material, for example in foamed plastic. The spring temper of the pressure pad (8) is co-ordinated with the spring temper of the material of the die body (2). A heat insulation layer (9) may be arranged between the pressure pad (8) and the die body (2) with heating device (5). This heat insulation layer (9) may also be omitted if the material of the pressure pad (8) itself achieves an adequate heat-insulation. It can be seen from FIG. 1 that the die body (2) is locally and individually heated, in fact at the place where the die face (3) is located. In contrast the areas of the bearing mask (4) are not heated. As a result these areas of the bearing mask (4) will receive on the surface a lower temperature than the die face (3).

FIG. 2 shows a cut-away from an embossing die (1) which has the construction represented in FIG. 1, at the moment of contact via a hot embossing film (10) onto the surface (11) of a workpiece (12) to be printed onto. The proportions represented are exaggerated in order to show clearly the problem of the sunk spots and irregularities within tolerances in the trend of the surface (11) of the workpiece (12). This surface (11) may display unevennesses (13), sunk spots or the like as they occur on an in principle level surface.

A good impression on the surface (11) of the workpiece (12) is then produced, if despite the unevennesses (13), the raised parts of the die body, in other words the die face (3), come into contact with the corresponding parts of the surface (11). The widths (14) of the raised parts of the die face (3), so the print intensity for example, may not undergo any changes as the unevennesses (13) are compensated, so in particular they should not be squashed flat locally or on the other hand experience too slight a contact to the hot embossing film (10) and the surface (11). Too slight a contact would lead to flaws in the impression. Too strong a contact leads to disturbingly deep imprints in the surface (11). It can be seen from FIG. 2 as well, that on principle the pressure pad (8) must only impose a comparatively small pressure, and indeed such that the die body (2), which itself is very thin, becomes formed elastically to the required extent. The embossing die (1) may be fixed to a piston head (15), only indicated diagrammatically here, corresponding to a double arrow (16), while the workpiece (12) is supported on a bench (17). The workpiece (12) here may be a solid body, as drawn here, or also a hollow body.

FIG. 3 shows the elevation of the freely visible surface of the die body (2) of the embossing die (1). However, only those parts of the die body (2) are shown which form the bearing mask (4). FIG. 4 then shows the complete elevation of the die body (2) of the embossing die (1), so including those parts of the die body which form the die face (3). The die face (3) appears here as negative. Clearly, the surface of the die face (3) and the bearing mask (4) lie in a common plane. The whole die body may be made from one continuous material piece.

Because of the localized positioning of the heating device, the one part of the surface of the die body (2) becomes die face (3) and the other part becomes bearing mask (4). FIG. 5 shows the heating device (5) belonging to the embodiment example of FIGS. 3 and 4, and indeed a conductor plate with a carrier film (6) and a metal resistance strip (7), which ends in terminals (18) which are considerably wider than the remaining parts of the metal resistance strip (7), so that as current passes in this thin and lightly charged metal resistance strip, the heat is specifically produced at the spots which are located behind the raised parts of the die face (3). In this way the distances for heat conduction become extremely short (compare FIG. 1), so that a small temperature difference of approximately 10° C. between the temperature of the conductor plate (7) and the die face (3) is sufficient for the transport of the heat.

FIG. 6 clarifies once again the basic layout of the parts of the apparatus shortly before the moment of contact, when the hot embossing film (10) is pressed by the embossing die (1) against the surface (11) of the workpiece (12). FIG. 7 illustrates another layout possiblilty. Here the embossing die (1) is arranged on the periphery of a roller (19). The pressure pad (8), which consists of elastically flexible material is arranged on the surface of the roller (19), which may consist of hard material, for example steel or plastic. Here the pressure pad (8) may be fixed permanently onto the roller (19). Interchangeable parts of the embossing die (1) here are the die body (2) and the heat-insulation layer (9) held onto the periphery by means of a spring element (20). If a heat-insulation layer (9) is not provided, then spring element (20) may also grip directly onto the carrier film (6) of the heating device (5).

The workpiece (12) to be printed onto here has a cylindrical form and may for example be a plastic bottle. The hot embossing film (10) runs between the workpiece (12) and the roller (19) with the embossing die (1). Clearly, as FIG. 6 shows, it must also be possible to print onto workpieces (12) with a flat surface (11), with this apparatus in accordance with FIG. 7.

The embodiment in accordance with FIG. 8 is particularly suitable for printing onto a concave shaped surface (11) of a workpiece (12). Here the die body (1) including the pressure pad (8) is carried on a formed steel sheet (21), which to a limited extent is itself flexible. It will be seen that as the parts approach together, the dies face (3) first touches in the middle, in other words at the point of greatest recess of the surface (11), and then rolls away to touch both sides.

With the layout possibility illustrated in FIG. 9, the whole embossing die (1) including the pressure pad (8) is arranged on a carrier film (22) in plastic. A hard roller (23) is assigned to the embossing die, and that rolls on the embossing die (1) according to the arrows shown, when the workpiece (12) to be printed onto is lifted according to the double arrow (16) and the embossing film (10) has come into contact with the bearing mask (4) and the die face (3). The roller (23) and the workpiece (12) may also be positioned to rotate in one fixed position in the horizontal direction, whereby the embossing die (1) is moved horizontally.

FIG. 10 shows a quite similar embodiment. Here, only a blade-shaped tool (24), bearing down suitably, is led over the rear side of the embossing die (1), after the workpiece (12) comes into contact with the embossing die (1) by intermediate clamping of the hot embossing film (10).

Here the impression is effectively slipped on. The embodiments of FIGS. 9 and 10 may be used for flat workpieces (12) as well as for curved workpiece surfaces. Then FIG. 11 shows a layout possibility, whereby behind the embossing die (1) a hydraulic or pneumatic force set (25) is provided, for example inflatable bellows or similar. The embossing stamp (1), itself representing the pressure pad (8) here too, may also be brought into contact with this force set (25).

Whereas with all the embodiments shown up to now in FIGS. 1 to 11, the positive force transfer relief was provided inset, in other words shaped by the conductor strips and the metal resistance strips (7) of the heating device, it is also possible to shape the force transfer relief (26) raised and projecting out of the rear surface of the die body (2), as illustrated in the embodiments of FIGS. 12 to 15. With the embodiment in accordance with FIG. 12 the embossing die there consists on the one hand of the embossing die (2) and on the other hand of the pressure pad (8), which is arranged on the carrier film (22). The die body (2) has the heating device (5) integrated, and that may be shaped as resistance heating element in the form of a strip with constant width or notched in the area of the impression. On both sides of the heating device (5) there are areas in elastic material, in particular rubber or silicon, whereby the die face (3) is formed on the side facing the workpiece at the raised parts there. The positive force transfer relief (26) projects towards the reverse side, so facing the pressure pad (8), that relief being positive and corresponding exactly in size and layout to the die face (3). Between the die body (2) and the pressure pad (8) a rubber strip may also be provided, which is not shown here for reasons of overall clarity.

As the parts are brought together for the purpose of hot embossing film printing, the forces which are imposed via the force transfer relief (26), are borne on the pressure pad (8) on a somewhat broader basis by means of the elastic rubber strip, so that the pressure pad (8) obtains a longer useful life. There the force transfer relief (26) does not form any sunk spots, which have lost their recovery capability . The rubber strip described may also be provided as a surface coating of the pressure pad (8).

FIG. 13 shows cut-aways from the die body (2), the first being the heating device (5) in the form of a metal strip, on which the die body (2) is also handled at the same time. Elastic material in the same or different thicknesses is applied to both sides of the heating device (5) and the metal strip, from which any material parts which are not desired are removed, by for example a laser engraving machine, so that shapes are created such as are illustrated in the next detail illustrations of FIG. 13. On the underside facing the workpiece the die body (2) is formed as negative and this represents the die face (3). The width (a) of the characters and lines there corresponds exactly to the width (b) of the characters and lines of the force transfer relief (26) in the contact surface (27) to the pressure pad (8) not shown here. On the one side of the heating device there is a negative and consequently on the other side of the heating device a positive. The construction may also be achieved in that the width on the contact surface (27) of the force transfer relief (26) is chosen to be larger than the width (a) of the characters in the die face (3). Finally , the reverse arrangement is possible. In this manner the forces to be transferred may be applied specifically with larger or smaller contact pressure.

The embodiment of an embossing station illustrated in FIG. 14 may be considered as an alternative to the embodiment in accordance with FIG. 7. The pressure pad (8) is on a roller (19) which may be made to rotate and/or rise and fall, yet not travel horizontally. The workpiece (12) to be printed onto together with its surface (11) may also rotate, but not travel horizontally. Here the die body (2) is arranged on the one side on a flat shaped heating device (5) which is shaped in the form of a strip. On the other side is the force transfer relief (26) with the contact surfaces (27). When the printing process is taking place, the heating device (5), which at the same time serves handling, travels in synchronisation back and forth according to the double arrow (28). To this end the workpiece (12) is lifted and/or the roller (19) with the pressure pad is lowered until the parts come together into contact. The hot embossing film (10) may then be led over rollers (29) in order on the one hand to bring it to the die face (3) under line contact, and on the other hand to guarantee the quite minimal cooling time, until the hot embossing film (10) is released again from the surface (11) of the workpiece (12). It is important that all parts of the impression are pressed only under line contact, and also that the cooling time is constant at all parts and that it only depends on the velocity of travel of the die body (2) according to the double arrow (28) during the printing process.

In FIG. 15 a particularly advantageous embodiment is illustrated. Here too the pressure pad (8) is on a roller (19) around which the die body (2) is conveyed in the form of an endless belt on a carrier film (6). The circulating belt also reaches over a return roller (30) which is positioned with parallel shaft vertically above the roller (19). On the driven belt circulating according to arrow (31) several utilities of die bodies (2) may be provided, so that large quantities of workpieces may be printed onto with such a printing belt.

Here too the carrier film (6) may be shaped as a heating device (5), so that the required heat is transferred over short distances into the die face (3). Since, in so far as a current supply to the heating device (5) and the carrier film (6) is required, it is also possible to consider a drive moving back and forth in synchronisation in the direction of arrow (31) or vice versa.

However, it is also possible to provide the heating device (5) outside and separate from the circulating belt. In this case it is advisable to drive continuously the circulating belt with the die body (2) only in one circulating direction according to arrow (31). The heating device (5) may then be from an infra red irradiation source (32), which transmits its heat emission according to the arrows (33). An aperture (34) may be in a fixed position or, as shown here, be in the form of a belt circulating around rollers (35) with suitable perforations (36), which belt may be driven intermittently or even continuously in the direction of an arrow (37). Also the aperture (34) may be located in one fixed position, whereby it is then preferably fitted with a cooling device on its rear side, so that it does not itself become an emission source through the irradiation by the infra red source (32). Furthermore, it is possible to place the infra red irradiation source (32) on a carriage (38) and drive it vertically upwards and downwards according to arrow (39) to coordinate with the movement of the aperture (34). In all these cases it is possible to irradiate and thereby to heat exclusively the die faces (3) of the die body (2) (even with a layout of several utilities on the circulating belt) specifically through the aperture (34) and for a set or even controllable time. This has the advantage that the heat sits directly on the surface of the die face (3) and as a result heat conduction does not have to cover any distance.

As the belt circulates around the rollers (19) and (30) the previously heated die face immediately arrives at the printing position. In this manner it is possible in a simple way to control efficiency and apply the heat transferred to the die face (3). The amount of heat required is extremely small, i.e. the heat is used sparingly and responsively. Naturally, here too, the force transfer relief (26) with the contact surfaces (27) to the pressure pad (8) is provided on the rear side of the circulating belt and the carrier film (6).

KEYING REFERENCE LIST

1=Embossing die
2=Die body
3=Die face
4=Bearing mask
5=Heating device
6=Carrier film
7=Metal resistance strip
8=Pressure pad
9=Heat-insulation layer
10=Hot embossing film
11=Surface
12=Workplace
13=Unevenness
14=Width
15=Piston head
16=Double arrow
17=Bench
18=Connection
19=Roller
20=Spring elements
21=Steel sheet
22=Carrier film
23=Roller
24=Blade-shaped tool
25=Power set
26=Force transfer relief
27=Contact surface
28=Double arrow
29=Roller
30=Return roller
31=Arrow
32=Infra red irradiation source
33=Arrow
34=Aperture
35=Roller
36=Perforations
37=Arrow
38=Carriage
39=Arrow

I claim:

1. Apparatus for dry printing onto a workpiece, comprising: a hot embossing film and an embossing die with a die face; means for moving the workpiece and said embossing die together under heat and pressure over time; means for intermediate clamping of said hot embossing film to hold the workpiece and said embossing die in contact so that heat is transferred and then removed for said hot embossing film to adhere onto the workpiece corresponding to said embossing die; means for releasing said film from the workpiece after a cooling period; a receiving station for the workpiece; synchronized feeding means for feeding said hot embossing film; means for heating said embossing die, said embossing die being a die body of elastically formable material; said die body having a wall thickness so that a side of said die body facing away from the die face has projection means forming a positive force transfer relief as said die body is placed onto the workpiece to be printed and forms locally and elastically onto the workplace surface; said relief corresponding substantially to said die face; an elastic pressure pad on a side of said die body facing away from said die face to form said die body locally and elastically.

2. Apparatus as defined in claim 1, wherein said heating means is located on said die body and forms a shape corresponding to said relief.

3. Apparatus as defined in claim 2, wherein said relief has a contact surface in contact with said pressure pad and shaped at least to correspond to said die face.

4. Apparatus as defined in claim 1, including a carrier body having a side for carrying said die body, said carrier body having another side for carrying said relief, said die body and said relief being in elastically formable material.

5. Apparatus as defined in claim 4, wherein said heating means is locating within said die body between said die face and said relief, said heating means forming also said carrier body.

6. Apparatus as defined in claim 4, wherein said die body and said relief comprise a plate movable reciprocatingly.

7. Apparatus as defined in claim 6, wherein said heating means is located outside said die body, said heat transfer taking place directly onto said die face.

8. Apparatus as defined in claim 7, including aperture means between said heating means and said die face.

9. Apparatus as defined in claim 4, wherein said die body and said relief comprise a circulating driven belt.

10. Apparatus as defined in claim 2, wherein said pressure pad has a hardness matching substantially the hardness of the die body material.

11. Apparatus as defined in claim 10, wherein said relief has a contact surface shaped the same as said die face; and a rubber strip separator between said contact surface and said pressure pad.

12. Apparatus as defined in claim 10, wherein said pressure pad comprises one of a hydraulic, pneumatic, and foam pad.

13. Apparatus as defined in claim 12, wherein said pressure paid exerts a force of substantially 100 g/cm$^2$.

14. Apparatus as defined in claim 2, wherein said heating means comprises a conductor plate with a carrier film and a metal resistance strip on said conductor plate and said carrier film, said metal resistance strip corresponding in shape to said die face.

15. Apparatus as defined in claim 14, including a heat-insulation layer of elastic material between said carrier film and said pressure pad.

16. Apparaturs as defined in claim 2, wherein said die body has areas shaped as a bearing mask.

17. Apparatus as defined in claim 16, wherein said pressure pad is permanently joined to said die body.

18. Apparatus as defined in claim 2, wherein said pressure pad has a wall thickness greater than the thickness of said die body.

19. Apparatus as defined in claim 18, wherein said pressure pad is comprised of heat-insulating material.

* * * * *